United States Patent [19]

Liebich et al.

[11] Patent Number: 4,954,103

[45] Date of Patent: Sep. 4, 1990

[54] PRESS IN CONTACT ELEMENT FOR CIRCUIT BOARDS

[75] Inventors: Ernst Liebich, Geltendorf, Fed. Rep. of Germany; Jacques Longueville, Oostkamp, Belgium

[73] Assignee: Siemens Aktiengesellschaft, Berlin and Munich

[21] Appl. No.: 444,749

[22] Filed: Dec. 1, 1989

[30] Foreign Application Priority Data

Dec. 2, 1988 [DE] Fed. Rep. of Germany ... 8815052[U]

[51] Int. Cl.[5] ..... H01R 13/428

[52] U.S. Cl. ..... 439/751; 439/82

[58] Field of Search ..... 439/82, 751, 825–827, 439/873

[56] References Cited

U.S. PATENT DOCUMENTS 4,762,498 8/1988 Harting et al. ..... 439/82

4,793,817 12/1988 Hiesbock ..... 439/82

FOREIGN PATENT DOCUMENTS 0089491 5/1988 European Pat. Off. .

*Primary Examiner*—Gary F. Paumen

*Attorney, Agent, or Firm*—Hill, Van Santen, Steadman & Simpson

[57] ABSTRACT

A contact element has an improved press in zone which is formed by two leg members extending substantially parallel to one another with an interconnecting web. The improvement is that the web is broken up into portions with adjacent portions having curvatures that extend in opposite directions to increase the strength of the press in zone and provides an optimally uniform, symmetrical pressure distribution between a bore wall and the press in zone of the contact element when the press in zone is plugged into a bore of a printed circuit board.

20 Claims, 2 Drawing Sheets

PRESS IN CONTACT ELEMENT FOR CIRCUIT BOARDS

BACKGROUND OF THE INVENTION

The present invention is directed to a contact element that comprises a pin-shaped section equipped for plugging into a bore of a printed circuit board. The pin-shaped section has two leg members that extend side-by-side in the plug-in direction and merge into one another at each end to provide a resilient section with at least one web extending between the leg members and having a central curvature or angling which is directed transverse relative to the longitudinal extent of the leg members.

U.S. Pat. No. 4,762,498, whose disclosure is incorporated by reference and which is based on the same German Application as European Patent No. 0 089 491, discloses a contact element which has two spaced leg members interconnected by a web that extends therebetween. The two spaced leg members with the web extending therebetween of this contact element promotes the resilient yielding of the leg members and, thereby, reduces the risk of too great and irreversible deformation of the leg members when plugging the contact element into a bore of a printed circuit board. As a result thereof, a permanent, firm seat of the leg members, which are biased against the bore's wall, is guaranteed.

SUMMARY OF THE INVENTION

It is an object of the present invention to construct a contact element of the above type species in such a way that the symmetrical absorption of the forces which the leg members exert on the wall of the bore by the web connecting the leg members is further improved.

This object is inventively achieved in an improvement in a contact element which comprises a pin-shaped section provided for being plugged into a bore of a printed circuit board, said pin-shaped section having two leg members extending side-by-side in a longitudinal plug-in direction and merging into one another at their ends, to form transition zones and a resilient section with a web extending between the leg members and having a central curvature or angling directed transversely relative to the longitudinal extent of the leg members. The improvements are that the web is divided into at least two parts, one following another in the plug-in direction, the central curvature or angling of adjacent web portions being in opposite directions.

By employing, for example, a web with four portions, wherein two are angled off to one side of the element and two are directed toward the opposite side of the element, an especially uniform distribution of forces occurs in the region of the press in zone or resilient section of the contact element defined by the length of the leg members.

In another modification of the invention, the wall thickness of the web portion is reduced as the distance from the leg members increases so that the central part of each web portion has the least thickness.

It can also be provided that the transition zones are web-free. As a result thereof, the transition zones are more elastic. It is also possible that triangle-shaped webs are provided in the region of the transition zone of the leg members. A central curvature or angling of these triangle-shaped webs is increasingly enlarged towards a neighboring web. The result is that an especially resistant press in zone is obtained.

In a further embodiment of the invention, the wall thickness of a triangle-shaped web toward a neighboring web is reduced from the thickness of the leg members to the thickness of the web of the neighboring web.

It can also be provided that the surfaces of the leg members facing toward one another extend parallel to one another and that the outside surfaces of the leg members which face away from one another extend in an acute angle in the plug-in direction of the contact element. This will facilitate the insertion of the press in zone into a bore of the printed circuit board.

It can also be provided that the leg members are provided with a rounding on an outer surface, which rounding is matched to the curvature of the bore. A result of this rounding is good contact of the leg members to the board of the printed circuit board.

Finally, neighboring webs are interconnected via partitions that are thin in comparison to the wall thickness of the webs and that said partitions are essentially directed transversely to the axis of the element and the longitudinal direction of the leg members. The result is that the webs are mutually supported via these partitions or walls.

Other advantages and features of the invention will be readily apparent from the following description of the preferred embodiments, the drawings and claims.

DESCRIPTION OF THE PREFERRED EMBODIMENTS

Figure 1:
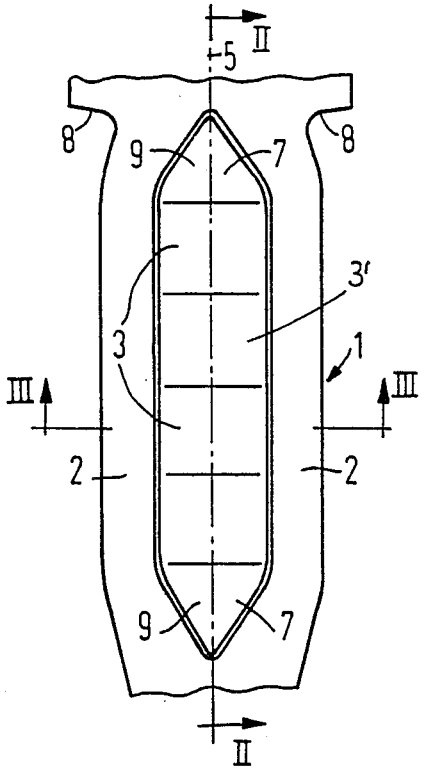
FIG. 1 is a front view of a press in zone of a contact element in accordance with the present invention.
Figure 2:
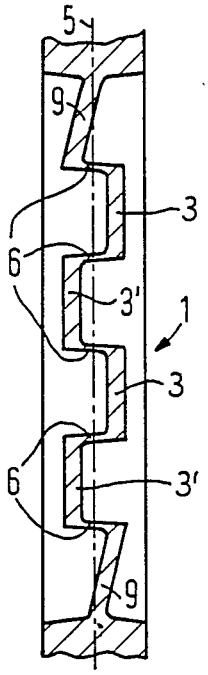
FIG. 2 is a longitudinal cross sectional view taken along the lines II—II of FIG. 1.
Figure 3:
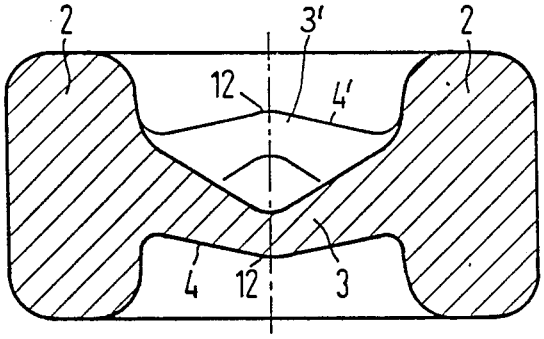
FIG. 3 is a cross sectional view taken along the lines III—III of FIG. 1.

The principles of the present invention are particularly useful when incorporated in a contact element which has a section, generally indicated at 1, that forms an elastic or resilient press in zone which fixes the contact element solder-free in a bore of a printed circuit board. As illustrated in FIGS. 1 and 3, the section 1 is formed by two leg members 2 which proceed side-by-side and are spaced from one another by a plurality of wall-like web portions 3 and 3' which have their flat sides 4 and 4' proceeding parallel to a longitudinal axis 5 of the contact element. As illustrated in FIG. 2, the web portions 3 are interconnected alternately with the web portions 3' along the axis of the contact element in the direction of which the leg members run. Thus, the elastic press in zone is formed by the two leg members 2 with the web portions 3 and 3' extending therebetween.

The web portions 3 and 3' are angled respectively curved transversely relative to the longitudinal direction of the leg members 2. The direction of curvature or respective angling of the portions follows one another in the longitudinal direction of the leg members 2 respectively in opposite directions. Thus, as illustrated in FIG. 2, the web portions 3 all extend to the right side, whereas the web portions 3′ extend to the left side.

When producing the angled or, respectively, curved curvatures of the web portions 3 and 3′, partitions 6, which extend substantially transverse relative to the longitudinal axis 5 of the press in zone and have a wall thickness that is significantly smaller than that of the web portions 3 and 3′ remain between the neighboring web portions 3 and 3′, which are interconnected by these partitions 6. The stability of the web portions 3 and 3′ is thereby increased.

As particularly illustrated in FIG. 3, the wall thickness of the web portion 3, as well as the wall thickness of the web portion 3′ are significantly less than the wall thickness of the beam-shaped leg members 2 and is reduced as the distance from the leg members increases so that a center of each of the portions at the center 12 of curvature for the web portions will be thinner than the web adjacent each of the leg members 2. This structure achieves a progressively increasing supporting effect of the portions 3 with respect to the leg members 2.

As illustrated in FIG. 1, the leg members 2 merge with one another at each of their two ends and form triangular transition zones 7 therebetween. At one end of the press in zone formed by the section 1 of the contact element, the leg members 2 merge into one another and form, for example, a pin that projects out of the bore on one side of the printed circuit board (not shown) in which the contact element is seated with the press in zone and this pin can be used as a supporting point for the connection of conductors or as a contact pin or contact blade for plugging a contact spring on. At the other end, the leg members 2 merge into one another and form a shoulder 8 that limits the insertion depth of the press in zone in a bore of the printed circuit board.

As illustrated in the embodiments of FIGS. 1, 2 and 3, the transition zones or regions 7 are provided with triangle-shaped webs 9 which are curved to extend in an opposite direction to the nearest web portion and these triangle-shaped portions have continuously reduced thickness as a distance from the neighboring leg members 2 decreases in a manner similar to that of the web portions 3 and 3′.

Figure 4:
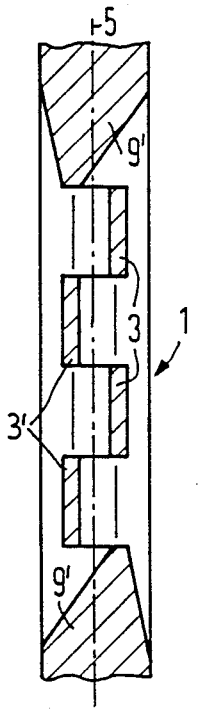
FIG. 4 is a cross sectional view similar to FIG. 2 of a modification of the embodiments of FIGS. 1, 2 and 3.
Figure 6:
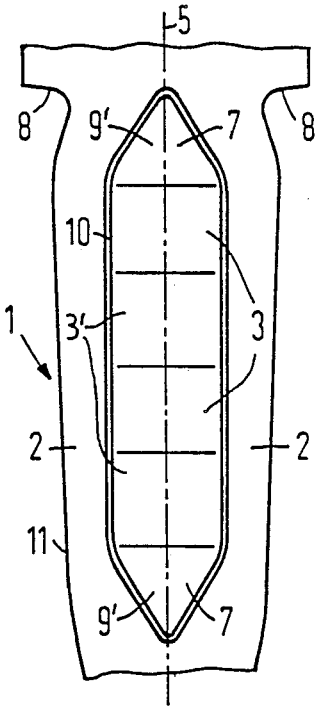
FIG. 6 is a front view similar to FIG. 1 of a third modification of the embodiments of FIGS. 1, 2 and 3.

In a modification illustrated in FIGS. 4 and 6, the wall thickness of each of the triangle-shaped webs 9′ diminishes towards the neighboring web portions 3 or 3′ from the thickness of the leg members 2 to the thickness of the portions 3 or 3′.

Figure 5:
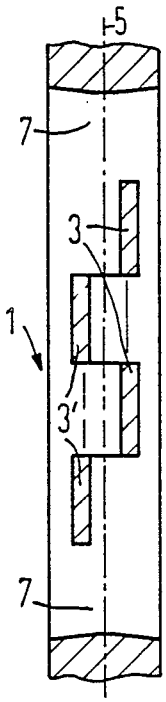
FIG. 5 is a cross sectional view similar to FIG. 2 of a second modification of the embodiments of FIGS. 1, 2 and 3.

In an embodiment illustrated in FIG. 5, each of the regions or zones 7 is free of any material so that there is an opening adjacent the apex of the merging leg members.

It is also advantageous to maintain the parallelism of the inner lateral faces or surfaces 10 of the leg members 2 which face one another and to have the outside faces or surfaces 11, which face away from one another, proceeding conically and interacting with one another. Thus, the two outside surfaces 11, as illustrated in FIG. 6, form a slight acute angle as they taper slightly inward from adjacent the shoulder 8 towards the end forming the pin of the contact element. This slight inward taper will help facilitate the insertion of the contact element into a printed circuit board and enable the pressing of the press in zone 1 into the bore. It should also be noted, as illustrated in FIG. 3, the outer edges of the leg members 2 can have a curved configuration, either as illustrated or with an overall curvature between the two corners to facilitate forming a contact with the surface of the bore.

Although various minor modifications may be suggested by those versed in the art, it should be understood that we wish to embody within the scope of the patent granted hereon all such modifications as reasonably and properly come within the scope of our contribution to the art.

We claim:

1. A contact element having a pin-shaped section for being plugged into a bore of a printed circuit board, said pin-shaped section including two leg members extending side-by-side in a plug-in direction and merging into one another at their ends to provide transition zones and including a resilient section comprising at least one web extending between the leg members, said web having curved portions, the improvement comprising said web being divided into at least two web portions following one another in a longitudinal direction of the pin-shaped section with alternating web portions extending to respective opposite sides of the element.

2. A contact element according to claim 1, wherein the thickness of the web portions is reduced towards a center of each of the web portions.

3. A contact element according to claim 2, wherein each of the transition zones are free of any web portions.

4. A contact element according to claim 2, wherein each of the transition zones between the leg members are provided with a triangle-shaped web whose central curvature is increasingly enlarged towards a neighboring web portion.

5. A contact element according to claim 4, wherein the thickness of each of the triangle-shaped webs is reduced towards a neighboring web portion from the thickness of the leg members to the thickness of the neighboring web portion.

6. A contact element according to claim 4, wherein the leg members have inner surfaces facing one another which extend parallel to each other and outer surfaces which face away from one another so that an outer profile of the contact element gradually tapers toward a forward end of the contact element to facilitate insertion of the element into a bore of a circuit board.

7. A contact element according to claim 4, wherein each of the leg members has an outer surface with a curved portion that is matched to the curvature of the bore to improve the engagement between the contact element and the surface of the bore.

8. A contact element according to claim 4, wherein the web portions are interconnected by partitions extending essentially transverse relative to a longitudinal axis of the contact element, said partitions being thin in comparison to the thickness of each of the web portions.

9. A contact element according to claim 3, wherein the leg members have inner surfaces facing one another which extend parallel to each other and outer surfaces which face away from one another so that an outer profile of the contact element gradually tapers toward a forward end of the contact element to facilitate insertion of the element into a bore of a circuit board.

10. A contact element according to claim 3, wherein each of the leg members has an outer surface with a curved portion that is matched to the curvature of the bore to improve the engagement between the contact element and the surface of the bore.

11. A contact element according to claim 3, wherein web portions are interconnected by partitions extending essentially transverse relative to a longitudinal axis of the contact element, said partitions being thin in comparison to the thickness of each of the web portions.

12. A contact element according to claim 2, wherein the leg members have inner surfaces facing one another which extend parallel to each other and outer surfaces which face away from one another so that an outer profile of the contact element gradually tapers toward a forward end of the contact element to facilitate insertion of the element into a bore of a circuit board.

13. A contact element according to claim 2, wherein each of the leg members has an outer surface with a curved portion that is matched to the curvature of the bore to improve the engagement between the contact element and the surface of the bore.

14. A contact element according to claim 2, wherein web portions are interconnected by partitions extending essentially transverse relative to a longitudinal axis of the contact element, said partitions being thin in comparison to the thickness of each of the web portions.

15. A contact element according to claim 1, wherein the transition zones where the leg members merge together are free of the web portions.

16. A contact element according to claim 1, wherein the transition zones formed by the leg members merging together at their ends have triangle-shaped webs having a central curvature increasingly enlarged towards a neighboring web portion.

17. A contact element according to claim 10, wherein the thickness of the triangle-shaped webs is reduced as the distance from the neighboring leg members increases.

18. A contact element according to claim 1, wherein the leg members have inner surfaces facing one another which extend parallel to each other and outer surfaces which face away from one another so that an outer profile of the contact element gradually tapers toward a forward end of the contact element to facilitate insertion of the element into a bore of a circuit board.

19. A contact element according to claim 1, wherein each of the leg members has an outer surface with a curved portion that is matched to the curvature of the bore to improve the engagement between the contact element and the surface of the bore.

20. A contact element according to claim 1, wherein the web portions are interconnected by partitions extending essentially transverse relative to a longitudinal axis of the contact element, said partitions being thin in comparison to the thickness of each of the web portions.

* * * * *